US010520842B2

(12) United States Patent
Tokura

(10) Patent No.: US 10,520,842 B2
(45) Date of Patent: Dec. 31, 2019

(54) YELLOW TONER

(71) Applicant: ZEON CORPORATION, Tokyo (JP)

(72) Inventor: Keita Tokura, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

(21) Appl. No.: 16/327,488

(22) PCT Filed: Aug. 18, 2017

(86) PCT No.: PCT/JP2017/029657
§ 371 (c)(1),
(2) Date: Feb. 22, 2019

(87) PCT Pub. No.: WO2018/043160
PCT Pub. Date: Mar. 8, 2018

(65) Prior Publication Data

US 2019/0171124 A1 Jun. 6, 2019

(30) Foreign Application Priority Data

Aug. 31, 2016 (JP) ..... 2016-169267
Sep. 30, 2016 (JP) ..... 2016-194712

(51) Int. Cl.
*G03G 9/09* (2006.01)
*G03G 9/087* (2006.01)
*G03G 9/08* (2006.01)

(52) U.S. Cl.
CPC ..... *G03G 9/091* (2013.01); *G03G 9/08711* (2013.01); *G03G 9/08753* (2013.01); *G03G 9/08755* (2013.01); *G03G 9/0806* (2013.01)

(58) Field of Classification Search
CPC ..... G03G 9/09; G03G 9/091
See application file for complete search history.

(56) References Cited

U.S. PATENT DOCUMENTS

2003/0207186 A1 11/2003 Itakura et al.
2017/0313884 A1 11/2017 Harada et al.

FOREIGN PATENT DOCUMENTS

JP 2001-109195 A 4/2001
JP 2003-280278 A 10/2003
JP 2006-145625 A 6/2006
JP 2016-089020 * 5/2016 ..... G03G 9/09
JP 2016-89020 A 5/2016

OTHER PUBLICATIONS

Translation of JP 2016-089020.*
International Search Report dated Oct. 24, 2017, issued in counterpart application No. PCT/JP2017/029657, with English translation. (2 pages).
Notification of Transmittal of Translation of the International Preliminary Report on Patentability (Form PCT/IB/338) issued in counterpart International Application No. PCT/JP2017/029657 dated Mar. 14, 2019 with Forms PCT/IB/373 and PCT/ISA/237. (6 pages).

* cited by examiner

*Primary Examiner* — Peter L Vajda
(74) *Attorney, Agent, or Firm* — Westerman, Hattori, Daniels & Adrian, LLP

(57) ABSTRACT

A yellow toner that is, even in small amounts, better in chroma than ever before. Disclosed is a yellow toner comprising a binder resin and a yellow colorant, wherein, as the yellow colorant, a compound A represented by the following general formula (1) and a compound B represented by the following formula (2) or (3) are contained, and wherein, with respect to 100 parts by mass of the binder resin, a content of the compound A is from 1 part by mass to 15 parts by mass, and a content of the compound B is from 0.1 part by mass to 8.0 parts by mass:

General Formula (1)

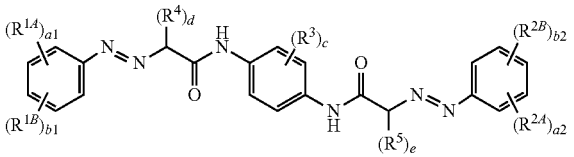

Formula (2)

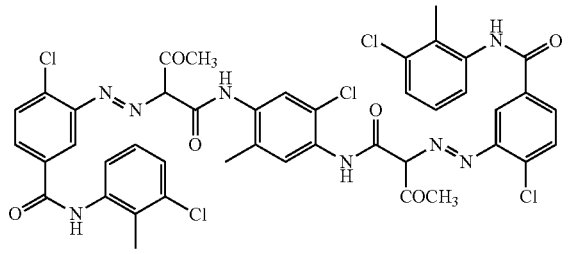

Formula (3)

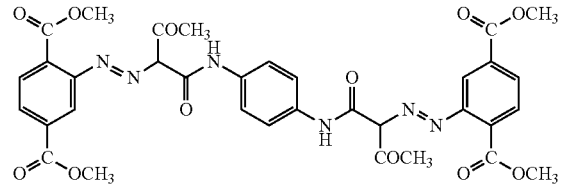

2 Claims, No Drawings

YELLOW TONER

TECHNICAL FIELD

The disclosure relates to a yellow toner that is, even in small amounts, better in chroma than ever before.

BACKGROUND ART

In an image forming device such as an electrophotographic device and an electrostatic recording device, first, an electrostatic latent image famed on the photoconductor is developed with a toner. Next, as needed, a toner image thus formed is transferred onto a transfer material such as a paper sheet and then fixed thereon by various methods such as heating, pressurization or solvent fume.

In the field of such an image forming device, a digital full-color copying machine and a digital full-color printer have been put to practical use. A digital full-color copying machine produces a full-color image as follows. First, an original color image is subjected to color separation with blue, green and red filters; an electrostatic latent image corresponding to the original color image, which is composed of dots that are 20 μm to 70 μm in diameter, is developed with yellow, magenta, cyan and black toners; and a full-color image is famed using the subtractive color mixing effect.

Recently, there is an increasing demand for full-color images with high image quality and high resolution. Especially, to increase color reproducibility, it is hoped that an image can be printed in the same hue as ink printing.

As a color pigment for a yellow toner, for example, a disazo pigment as typified by C.I. Pigment Yellow 12, 13 and 17, and a monoazo pigment as typified by C.I. Pigment Yellow 74, 97 and 98 have been generally used.

Patent Literature 1 discloses a yellow toner comprising C.I. Pigment Yellow 214 and C.I. Pigment Yellow 139 as colorants. Patent Literature 1 describes that a toner excellent in fixability and color properties is obtained by interaction between the amino groups of C.I. Pigment Yellow 214 and the carbonyl groups of C.I. Pigment Yellow 139.

Patent Literature 2 discloses a yellow toner comprising C.I. Pigment Yellow 93 and C.I. Solvent Yellow 162 as colorants. Patent Literature 2 describes that by containing such colorants, a yellow image projected by an overhead projector (OHP) shows excellent transparency.

Patent Literature 3 discloses a yellow toner comprising a combination of, as yellow colorants, C.I. Pigment Yellow 155 with C.I. Pigment Yellow 110 or the like at a specific ratio. Patent Literature 3 describes that by using such colorants, an excellent resistance to hot offset can be obtained even when using heat-and-pressure fixing means in which any oil is not used or such an oil is used in a small quantity; both long-team storage stability in a high-temperature environment and low-temperature fixing performance can be achieved; and color tones of process inks (color reproduction ranges) can be covered.

CITATION LIST

Patent Literature 1: Japanese Patent Application Laid-Open (JP-A) No. 2006-145625

Patent Literature 2: JP-A No. 2001-109195

Patent Literature 3: JP-A No. 2003-280278

SUMMARY OF INVENTION

Technical Problem

The applications of an electrophotographic image forming device have been extended from general copying machines and printers used to print or copy office documents, to the field of production of printed matters for use outside the office, in particular, to the print-on-demand (POD) market that is an area of quick printing, since the image forming device can easily print variable information from electronic data.

However, due to the following reasons, it cannot be said that the yellow toners disclosed in Patent Literatures 1 to 3 are applicable to the various applications mentioned above. First, the combination of the colorants disclosed in Patent Literature 1 (C.I. Pigment Yellow 214 and C.I. Pigment Yellow 139) has a problem of low reflection density of the yellow toner, since the two pigments have low coloring power. This combination has another problem in that the color is dull since the colorants have a large difference in hue. As with this case, the combination of the colorants disclosed in Patent Literature 3 (e.g., C.I. Pigment Yellow 155 and C.I. Pigment Yellow 110) has a problem of low refection density and a problem of dull color due to a difference in hue. In addition, the combination of the colorants disclosed in Patent Literature 2 (C.I. Pigment Yellow 93 and C.I. Solvent Yellow 162) has a problem in that C.I. Solvent Yellow 162 has insufficient light resistance and causes a decrease in the reflection density of the yellow toner over time.

For the chroma of a printed product, the level of demand has been rapidly increased in recent years, in order to be applicable to the wide range of applications. To satisfy such a high level of demand, an object of the present disclosure is to provide a yellow toner that is, even in small amounts, better in chroma than ever before.

Solution to Problem

To attain the object, the inventor of the present invention conducted detailed research and found that the yellow toner that shows, even in small amounts, higher chroma than ever before, is obtained by using the combination of compounds A and B as a yellow colorant, each of which has a specific chemical structure. Based on this finding, the inventor achieved the present invention.

The yellow toner of the present disclosure is a yellow toner comprising a binder resin and a yellow colorant, wherein, as the yellow colorant, a compound A represented by the following general formula (1) and a compound B represented by the following formula (2) or (3) are contained, and wherein, with respect to 100 parts by mass of the binder resin, a content of the compound A is from 1 part by mass to 15 parts by mass, and a content of the compound B is from 0.1 part by mass to 8.0 parts by mass:

General Formula (1)

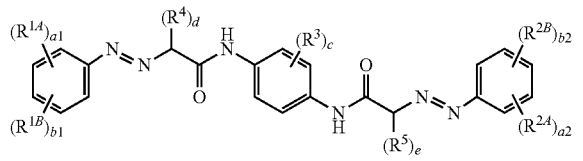

where $R^{1A}$, $R^{1B}$, $R^{2A}$ and $R^{2B}$ are each independently a halogen atom, an alkyl group, an alkoxy group, an amino group, a nitro group, an acetylamido group (—$NHCOCH_3$), a methyl ester group (—$COOCH_3$) or a primary amide group (—$CONH_2$); $R^3$ is a halogen atom; $R^4$ and $R^5$ are each independently a halogen atom, an alkyl group, a methoxy group, an amino group, a nitro group, an acetylamido group (—$NHCOCH_3$), an acetyl group (—$COCH_3$), a methyl ester group (—$COOCH_3$) or a primary amide group (—$CONH_2$); a1 and b1 are non-negative integers that a sum of the non-negative integers a1 and b1 is 1 or more and 3 or less; a2 and b2 are non-negative integers that a sum of the non-negative integers a2 and b2 is 1 or more and 3 or less; c is an integer of 1 or more and 3 or less; and d and e are each independently 1 or 2, Formula (2)

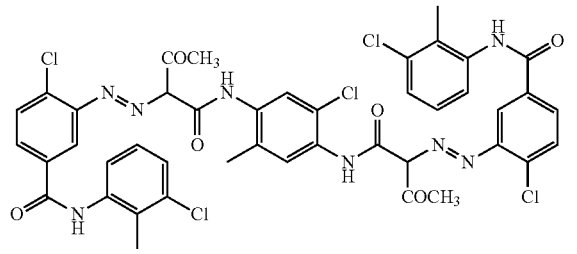

Formula (3)

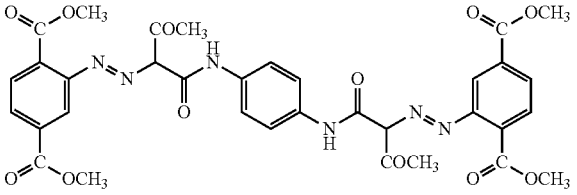

In the present disclosure, a mass ratio of the content of the compound A to the content of the compound B (compound A/compound B) is preferably from 0.1 to 10.0.

Advantageous Effects of Invention

According to the present disclosure, as described above, by using the compound A having the chemical structure represented by the general formula (1) in combination with the compound B, due to the presence of the compound A, the dispersion stability of the compound B in the polymerizable monomer composition or binder resin is increased; therefore, the yellow toner that is, even in small amounts, high in chroma and excellent in yellow coloring properties, is provided.

DESCRIPTION OF EMBODIMENTS

The yellow toner of the present disclosure is a yellow toner comprising a binder resin and a yellow colorant, wherein, as the yellow colorant, a compound A represented by the following general formula (1) and a compound B represented by the following formula (2) or (3) are contained, and wherein, with respect to 100 parts by mass of the binder resin, a content of the compound A is from 1 part by mass to 15 parts by mass, and a content of the compound B is from 0.1 part by mass to 8.0 parts by mass:

General Formula (1)

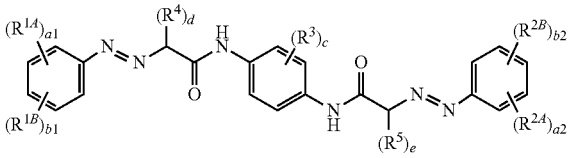

where $R^{1A}$, $R^{1B}$, $R^{2A}$ and $R^{2B}$ are each independently a halogen atom, an alkyl group, an alkoxy group, an amino group, a nitro group, an acetylamido group (—$NHCOCH_3$), a methyl ester group (—$COOCH_3$) or a primary amide group (—$CONH_2$); $R^3$ is a halogen atom; $R^4$ and $R^5$ are each independently a halogen atom, an alkyl group, a methoxy group, an amino group, a nitro group, an acetylamido group (—$NHCOCH_3$), an acetyl group (—$COCH_3$), a methyl ester group (—$COOCH_3$) or a primary amide group (—$CONH_2$); a1 and b1 are non-negative integers that a sum of the non-negative integers a1 and b1 is 1 or more and 3 or less; a2 and b2 are non-negative integers that a sum of the non-negative integers a2 and b2 is 1 or more and 3 or less; c is an integer of 1 or more and 3 or less; and d and e are each independently 1 or 2, Formula (2)

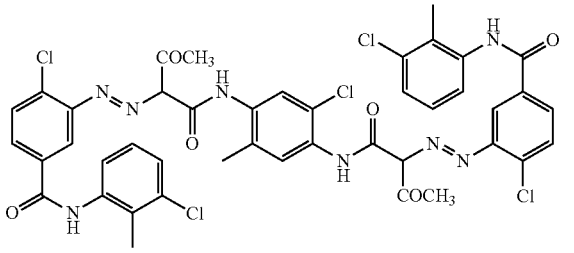

Formula (3)

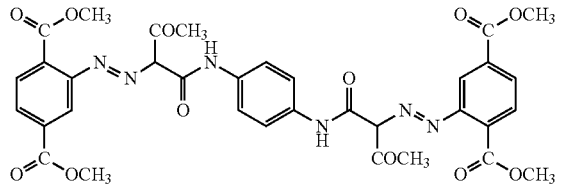

Hereinafter, the yellow toner of the present disclosure may be simply referred to as "toner".

Hereinafter, a method for producing yellow colored resin particles preferably used in the present disclosure (hereinafter they may be simply referred to as "colored resin particles"), yellow colored resin particles obtained by the production method, a method for producing a yellow toner using the yellow colored resin particles, and the yellow toner of the present disclosure will be described in order.

1. Method for Producing Colored Resin Particles

In general, methods for producing colored resin particles are broadly classified into dry methods such as a pulverization method and wet methods such as an emulsion polymerization agglomeration method, a suspension polymerization method and a solution suspension method. The wet methods are preferred since a toner that has excellent printing characteristics such as image reproducibility can be easily obtained. Among the wet methods, polymerization methods such as the emulsion polymerization agglomeration method and the suspension polymerization method are preferred, since a toner that has relatively small particle size distribution in micron order can be easily obtained. Among the polymerization methods, the suspension polymerization method is more preferred.

The emulsion polymerization agglomeration method is a method for producing colored resin particles by polymerizing emulsified polymerizable monomers to obtain a resin microparticle emulsion, and aggregating the resulting resin microparticles with a colorant dispersion, etc. The solution suspension method is a method for producing colored resin particles by forming droplets of a solution in an aqueous medium, the solution containing toner components such as a binder resin and a colorant dissolved or dispersed in an organic solvent, and removing the organic solvent. Both methods can be carried out by known methods.

The colored resin particles used in the present disclosure can be produced by the wet methods or the dry methods. The wet methods are preferred, and among the wet methods, the suspension polymerization method is particularly preferred. By the suspension polymerization method, the colored resin particles are produced through the processes described below.

(A) Suspension Polymerization Method (A-1) Preparation Process of Polymerizable Monomer Composition First, a polymerizable monomer, a yellow colorant, and other additives added as needed, such as a charge control agent, a pigment dispersant and a release agent, are mixed to prepare a polymerizable monomer composition. For example, a media type dispersing machine is used for the mixing in the preparation of the polymerizable monomer composition.

In the present disclosure, the polymerizable monomer means a monomer having a polymerizable functional group, and the polymerizable monomer is polymerized into a binder resin. As a main component of the polymerizable monomer, a monovinyl monomer is preferably used. As the monovinyl monomer, examples include, but are not limited to, styrene; styrene derivatives such as vinyl toluene and α-methylstyrene; acrylic acid and methacrylic acid; acrylic acid esters such as methyl acrylate, ethyl acrylate, propyl acrylate, butyl acrylate, 2-ethylhexyl acrylate and dimethylaminoethyl acrylate; methacrylic acid esters such as methyl methacrylate, ethyl methacrylate, propyl methacrylate, butyl methacrylate, 2-ethylhexyl methacrylate and dimethylaminoethyl methacrylate; nitrile compounds such as acrylonitrile and methacrylonitrile; amide compounds such as acrylamide and methacrylamide; and olefins such as ethylene, propylene and butylene. These monovinyl monomers may be used alone or in combination of two or more kinds. Among them, styrene, styrene derivatives, and derivatives of acrylic acids or methacrylic acids are preferably used as the monovinyl monomer.

To improve hot offset and storage stability, it is preferable to use a crosslinkable polymerizable monomer together with the monovinyl monomer. The crosslinkable polymerizable monomer means a monomer having two or more polymerizable functional groups. As the crosslinkable polymerizable monomer, examples include, but are not limited to, aromatic divinyl compounds such as divinyl benzene, divinyl naphthalene and derivatives thereof; ester compounds such as ethylene glycol dimethacrylate and diethylene glycol dimethacrylate, in which two or more carboxylic acids are esterified to alcohol having two or more hydroxyl groups; other divinyl compounds such as N,N-divinylaniline and divinyl ether; and compounds having three or more vinyl groups. These crosslinkable polymerizable monomers can be used alone or in combination of two or more kinds.

In the present disclosure, it is desirable that the amount of the crosslinkable polymerizable monomer is generally from 0.1 part by mass to 5 parts by mass, and preferably from 0.3 part by mass to 2 parts by mass, with respect to 100 parts by mass of the monovinyl monomer.

Also, it is preferable to use a macromonomer as a part of the polymerizable monomer, since the balance between the storage stability and low-temperature fixability of the toner to be obtained can be improved. The macromonomer is a reactive oligomer or polymer having a polymerizable carbon-carbon unsaturated double bond at the end of a polymer chain and generally having a number average molecular mass of from 1,000 to 30,000. The macromonomer is preferably one that can provide a polymer having a higher glass transition temperature (hereinafter may be referred to as "Tg") than a polymer obtained by polymerization of the monovinyl monomer. The amount of the macromonomer is preferably from 0.03 part by mass to 5 parts by mass, and more preferably from 0.05 part by mass to 1 part by mass, with respect to 100 parts by mass of the monovinyl monomer.

In the present disclosure, the compound A and the compound B are contained as the yellow colorant.

Hereinafter, the compound A used in the present disclosure will be described in detail.

The compound A of the present disclosure is a disazo compound represented by the following general formula (1):

General Formula (1)

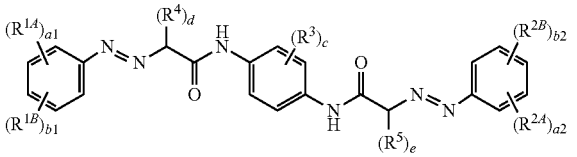

In the general formula (1), $R^{1A}$, $R^{1B}$, $R^{2A}$ and $R^{2B}$ are each independently a halogen atom, an alkyl group, an alkoxy group, an amino group, a nitro group, an acetylamido group (—$NHCOCH_3$), a methyl ester group (—$COOCH_3$) or a primary amide group (—$CONH_2$). It is preferable that $R^{1A}$, $R^{1B}$, $R^{2A}$ and $R^{2B}$ are each independently a methyl group, a methoxy group, an amino group, a nitro group, an acetylamido group or a primary amide group. It is more preferable that $R^{1A}$ and $R^{2A}$ are methyl groups, and $R^{1B}$ and $R^{2B}$ are primary amide groups. Each of $R^{1A}$, $R^{1B}$, $R^{2A}$ and $R^{2B}$ may have a bond with any carbon atom on the benzene ring (except the carbon atom bound to the azo group (—N═N—)).

In the general formula (1), a1 and b1 are non-negative integers that a sum of the non-negative integers a1 and b1 is 1 or more and 3 or less, and a2 and b2 are non-negative integers that a sum of the non-negative integers a2 and b2 is 1 or more and 3 or less. It is preferable that a1, b1, a2 and b2 are each 1.

In the general formula (1), $R^3$ is a halogen atom and is preferably a chlorine atom. $R^3$ may have a bond with any carbon atom on the benzene ring (except the carbon atoms bound to the amide groups (—CO—NH—)).

In the general formula (1), c is an integer of 1 or more and 3 or less, and it is preferably 1.

In the general formula (1), $R^4$ and $R^5$ are each independently a halogen atom, an alkyl group, a methoxy group, an amino group, a nitro group, an acetylamido group (—$NHCOCH_3$), an acetyl group (—$COCH_3$), a methyl ester group (—$COOCH_3$) or a primary amide group (—$CONH_2$). It is preferable that $R^4$ and $R^5$ are acetyl groups.

In the general formula (1), d and e are each independently 1 or 2. It is preferable that d and e are 1.

As the compound A represented by the general formula (1), examples include, but are not limited to, the following compounds. Of the following examples, the compound represented by the following formula (1A) is C.I. Pigment Yellow 214 (CAS No. 254430-12-5, hue angle: 97°) and the compound represented by the following formula (1B) is C.I. Pigment Yellow 219 (CAS No. 347174-87-2, hue angle: 96°).

The compound A used in the present disclosure is not limited to the following examples. Tautomers of the following examples can be also preferably used as the compound A of the present disclosure.

Formula (1A)

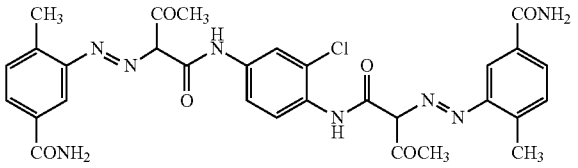

Formula (1B)

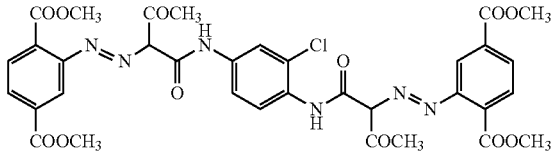

The compound A may be a commercially-available product or may be synthesized in advance.

As the method for synthesizing the compound A, examples include, but are not limited to, a method of coupling one equivalent of an N,N'-1,4-diacetylphenylenediamine derivative represented by the following general formula (a) with two equivalents of a benzenediazonium derivative represented by the following general formula (b) (see Japanese Examined Patent Application Publication No. 48-13692).

General Formula (a)

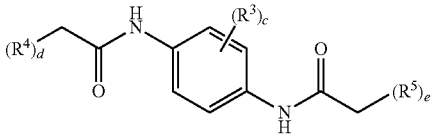

where $R^3$, $R^4$ and $R^5$ are the same groups as $R^3$, $R^4$ and $R^5$ in the general formula (1), respectively, and c, d and e are the same numbers as c, d and e in the general formula (1), respectively.

General Formula (b)

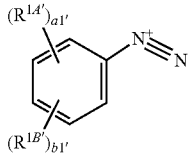

where $R^{1A'}$ is the same group as $R^{1A}$ or $R^{2A}$ in the general formula (1); $R^{1B'}$ is the same group as $R^{1B}$ or $R^{2B}$ in the general formula (1); a1' is the same number as a1 or a2 in the general formula (1); and b1' is the same number as b1 or b2 in the general formula (1).

The content of the compound A is from 1 part by mass to 15 parts by mass, preferably from 3 parts by mass to 13 parts by mass, more preferably from 5 parts by mass to 12 parts by mass, and still more preferably from 6 parts by mass to 10 parts by mass, with respect to 100 parts by mass of the binder resin. When the content of the compound A is less than 1 part by mass with respect to 100 parts by mass of the binder resin, an aimed reflection density cannot be obtained. When the content of the compound A is more than 15 parts by mass with respect to 100 parts by mass of the binder resin, the particle size distribution of the toner thus obtained deteriorates.

In the present disclosure, besides the compound A, the compound B represented by the following formula (2) (C.I. Pigment Yellow 93, CAS No. 5580-57-4, hue angle: 95°) or the following formula (3) (C.I. Pigment Yellow 155, CAS No. 68516-73-4, hue angle: 95°) is contained as the yellow colorant.

A point in common between the compound represented by the following formula (2) and the compound represented by the following formula (3) is that they are disazo compounds. The hue angles of the compounds are equal to each other.

Formula (2)

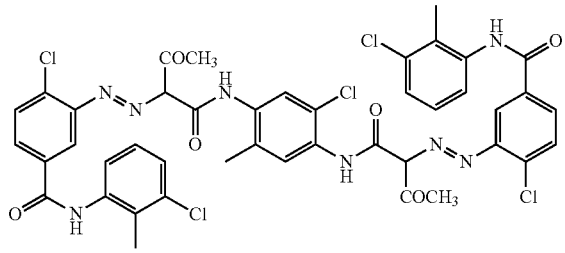

Formula (3)

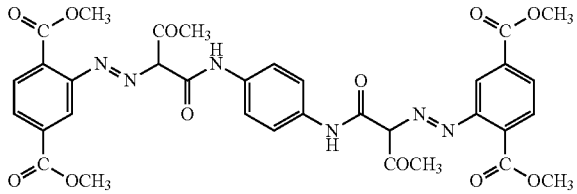

The content of the compound B is from 0.1 part by mass to 8.0 parts by mass, preferably from 0.5 part by mass to 7.0 parts by mass, more preferably from 1.0 part by mass to 6.0 parts by mass, and still more preferably from 2.0 parts by mass to 6.0 parts by mass, with respect to 100 parts by mass of the binder resin. When the content of the compound B is less than 0.1 part by mass with respect to 100 parts by mass of the binder resin, an aimed chroma cannot be obtained. When the content of the compound B is more than 8.0 parts by mass with respect to 100 parts by mass of the binder resin, the fixability of the toner thus obtained is likely to decrease.

In the present disclosure, the mass ratio of the content of the compound A to the content of the compound B (compound A/compound B) is preferably from 0.1 to 10.0, more preferably from 0.5 to 8.0, and still more preferably from 0.7 to 7.0.

When the mass ratio is less than 0.1 or more than 10.0, the yellow coloring properties and chroma of the yellow toner may decrease. This is because, when either the content ratio of the compound A or that of the compound B is excessively large, the yellow coloring properties and chroma of the yellow toner are less likely to be increased with balance.

The total content of the compounds A and B is preferably from 1.1 parts by mass to 23 parts by mass, more preferably from 5 parts by mass to 16 parts by mass, and still more preferably from 8 parts by mass to 13 parts by mass, with respect to 100 parts by mass of the binder resin.

When the total content of the compounds A and B is less than 1.1 parts by mass with respect to 100 parts by mass of the binder resin, the content ratio of the yellow colorant in the toner may be too small to obtain an aimed chroma or aimed yellow coloring properties. On the other hand, when the total content is more than 23 parts by mass, the total content ratio of the yellow colorant in the toner may be too high to obtain an aimed chroma, due to deterioration of the dispersibility of the compound A.

The principle of the effect provided by the use of the combination of the compounds A and B, is not clear. However, it is considered as follows: by using the combination of the compounds, due to the presence of the compound A having the specific chemical structure, the dispersion stability of the compound B in the polymerizable monomer composition or binder resin is increased; therefore, the toner can provide, even in small amounts, high chroma and excellent yellow coloring properties.

As another additive, a positively or negatively chargeable charge control agent can be used to improve the chargeability of the toner.

The charge control agent is not particularly limited, as long as it is one that is generally used as a charge control agent for toners. Among charge control agents, a positively or negatively chargeable charge control resin is preferred, since the charge control resin is highly compatible with the polymerizable monomer and can impart stable chargeability (charge stability) to the toner particles. From the viewpoint of obtaining a positively chargeable toner, a positively chargeable charge control resin is more preferred.

As the positively chargeable charge control agent, examples include, but are not limited to, a nigrosine dye, a quaternary ammonium salt, a triaminotriphenylmethane compound, an imidazole compound, and, as charge control resin preferably used as the positively chargeable charge control agent, a polyamine resin, a quaternary ammonium group-containing copolymer, and a quaternary ammonium salt group-containing copolymer.

As the negatively chargeable charge control agent, examples include, but are not limited to, an azo dye containing a metal such as Cr, Co, Al and Fe; a metal salicylate compound; a metal alkylsalicylate compound; and as charge control resin preferably used as the negatively chargeable charge control agent, a sulfonic acid group-containing copolymer, a sulfonic acid salt group-containing copolymer, a carboxylic acid group-containing copolymer and a carboxylic acid salt group-containing copolymer.

In the present disclosure, it is desirable that the amount of the charge control agent is generally from 0.01 part by mass to 10 parts by mass, and preferably from 0.03 part by mass to 8 parts by mass, with respect to 100 parts by mass of the monovinyl monomer. When the added amount of the charge control agent is less than 0.01 part by mass, fog may occur. On the other hand, when the added amount of the charge control agent is more than 10 parts by mass, soiling in printing may occur.

In the present disclosure, the pigment is preferably dispersed in the monomer, in the presence of a coupling agent serving as a pigment dispersant. Therefore, the pigment is surface-treated with the coupling agent.

As the coupling agent, examples include, but are not limited to, a silane coupling agent, a titanium coupling agent, and an aluminum coupling agent. Among them, an aluminum coupling agent is preferred. The amount of the coupling agent added is preferably from 0.05 part by mass to 5 parts by mass, more preferably from 0.2 part by mass to 4 parts by mass, and still more preferably from 1 part by mass to 3 parts by mass, with respect to 100 parts by mass of the yellow colorant. When the amount of the coupling agent is more than 5 parts by mass, a coagulum (an aggregate of particles) may be produced. When the amount of the coupling agent is less than 0.05 part by mass, both the reflection density and chroma of the thus-obtained toner may not be increased.

The aluminum coupling agent is preferably used in the present disclosure. Hereinafter, the aluminum coupling agent will be described. As the aluminum coupling agent, examples include, but are not limited to, alkylacetoacetate aluminum diisopropylate, aluminum tris(ethylacetoacetate), aluminum monoacetylacetate bis(alkylacetoacetate) and aluminum tris(acetylacetate).

Among these aluminum coupling agents, alkylacetoacetate aluminum diisopropylate represented by the following general formula (i) is preferred:

General Formula (i)

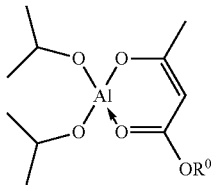

where $R^0$ is an alkyl group.

$R^0$ is generally an alkyl group having 10 to 30 carbon atoms, preferably an alkyl group having 15 to 25 carbon atoms, and particularly preferably an alkyl group having 18 carbon atoms.

As the alkylacetoacetate aluminum diisopropylate, examples include, but are not limited to, PLENACT AL-M (product name, manufactured by Ajinomoto Fine-Techno. Co., Inc.)

The method for surface-treating the yellow colorant with the coupling agent may be a wet treatment method or a dry treatment method.

The wet treatment method is carried out as follows: a solution of the coupling agent is prepared; the yellow colorant is added therein to form a slurry; the slurry thus obtained is sufficiently stirred and mixed; the yellow colorant is separated therefrom by decantation, centrifugal separation or the like; the separated yellow colorant is dried by heating and, as needed, pulverized again, thereby completing the surface treatment. By the wet treatment method, the surface can be easily and uniformly treated.

In general, the coupling agent is used for the surface treatment, in the form of an aqueous solution in which the content of the coupling agent is from about 0.1% by mass to 2.0% by mass. When the coupling agent has poor compatibility with water, a component for increasing the solubility of the coupling agent may be added, such as an acetic acid aqueous solution of from about 0.1% by mass to 2.0% by mass, a mixed solution of water and alcohol, or a mixed solution of acetic acid aqueous solution and alcohol.

The process of preparing the aqueous solution of the coupling agent is as follows. First, while stirring water, or while stirring water that contains other component as needed, such as an acetic acid aqueous solution, the coupling agent is added dropwise thereto. The stirring rate should be as fast as possible, while preventing the solution from splashing. As for the rate of dropwise addition, rapid dropwise addition should be avoided to prevent gelation of the solution. Even after the dropwise addition is completed, the stirring is further continued for 30 minutes to 60 minutes. The hydrolysis of the coupling agent is finished when the aqueous solution becomes almost clear. As needed, the aqueous solution is filtered and used. When an insoluble or suspended matter is apparent, the aqueous solution is subjected to cycle filtration through a cartridge having a pore diameter of 0.5 μm or less.

Meanwhile, in the case of the dry treatment method, it is carried out as follows. First, a capacitively small amount of diluted or undiluted solution of the coupling agent is added to the yellow colorant. They are sufficiently stirred, mixed and dried to complete the surface treatment, while preventing the yellow colorant from being slurried and while keeping the colorant in a powdery state. After the stirring, as needed, the mixture may be matured to apply the coupling agent to the yellow colorant and then dried. A stirrer is used for the stirring. As the stirrer, examples include, but are not limited to, FM MIXER (product name) and a V-type blender. By the wet treatment method, the process of separating the yellow colorant from an excess treatment solution is not needed, and energy required for drying moisture can be saved. Therefore, the wet treatment method can reduce the treatment cost and is suitable for mass processing.

In the case of the dry treatment method, it is carried out as follows, for example. First, while stirring the yellow colorant with FM MIXER (product name), from 10 parts by mass to 100 parts by mass of a treatment solution having a coupling agent concentration of from 0.1% by mass to 10% by mass, is added to 100 parts by mass of the yellow colorant. They are stirred for about 10 minutes to sufficiently apply the added treatment solution to the yellow colorant. The treatment solution is further added to the yellow colorant so that the total amount of the treatment solution is from 1 part by mass to 10 parts by mass. The mixture is heated at a temperature of from 80° C. to 100° C. for about one hour, thereby completing the surface treatment of the yellow colorant.

As another additive, a molecular weight modifier is preferably used in the polymerization of the polymerizable monomer that is polymerized into a binder resin.

The molecular weight modifier is not particularly limited, as long as it is one that is generally used as a molecular weight modifier for toners. As the molecular weight modifier, examples include, but are not limited to, mercaptans such as t-dodecyl mercaptan, n-dodecyl mercaptan, n-octyl mercaptan and 2,2,4,6,6-pentamethylheptane-4-thiol, and thiuram disulfides such as tetramethyl thiuram disulfide, tetraethyl thiuram disulfide, tetrabutyl thiuram disulfide, N,N'-dimethyl-N,N'-diphenyl thiuram disulfide, and N,N'-dioctadecyl-N,N'-diisopropyl thiuram disulfide. These molecular weight modifiers may be used alone or in combination of two or more kinds.

In the present disclosure, it is desirable that the amount of the molecular weight modifier is generally from 0.01 part by mass to 10 parts by mass, and preferably from 0.1 part by mass to 5 parts by mass, with respect to 100 parts by mass of the monovinyl monomer.

As another additive, it is preferable to add a release agent. By adding the release agent, the releasability of the toner from a fixing roller upon fixing, can be improved. The release agent is not particularly limited, as long as it is one that is generally used as a release agent in toner. As the release agent, examples include, but are not limited to, low-molecular-weight polyolefin waxes and modified waxes thereof; petroleum waxes such as paraffin; mineral waxes such as ozokerite; synthetic waxes such as Fischer-Tropsch wax; and ester waxes such as dipentaerythritol ester and carnauba. Since the toner can achieve a balance between storage stability and low-temperature fixability, ester waxes are preferred, and a synthetic ester wax obtained by esterifying alcohol and carboxylic acid is more preferred. Among them, a synthetic ester wax obtained by esterifying polyalcohol and monocarboxylic acid is still more preferred. These release agents may be used alone or in combination of two or more kinds.

The amount of the release agent is preferably from 0.1 part by mass to 30 parts by mass, and more preferably from 1 part by mass to 20 parts by mass, with respect to 100 parts by mass of the monovinyl monomer.

(A-2) Suspension Process of Obtaining Suspension (Droplets Forming Process)

In the present disclosure, the polymerizable monomer composition containing the polymerizable monomer and the yellow colorant is dispersed in an aqueous medium containing a dispersion stabilizer, and a polymerization initiator is added therein. Then, the polymerizable monomer composition are famed into droplets. The method for forming the droplets is not particularly limited. For example, the droplets are famed by means of a device capable of strong stirring, such as an (in-line type) emulsifying and dispersing machine (product name: MILDER, manufactured by: Pacific Machinery & Engineering Co., Ltd.) and a high-speed emulsifying and dispersing machine (product name: T. K. HOMOMIXER MARK II, manufactured by: PRIMIX Corporation).

As the polymerization initiator, examples include, but are not limited to, persulfates such as potassium persulfate and ammonium persulfate; azo compounds such as 4,4'-azobis(4-cyanovaleric acid), 2,2'-azobis(2-methyl-N-(2-hydroxyethyl)propionamide), 2,2'-azobis(2-amidinopropane)dihydrochloride, 2,2'-azobis(2,4-dimethylvaleronitrile) and 2,2'-azobisisobutyronitrile; and organic peroxides such as di-t-butylperoxide, benzoylperoxide, t-butylperoxy-2-ethylhexanoate, t-hexylperoxy-2-ethylbutanoate, t-butylperoxy-2-ethylbutanoate, diisopropylperoxydicarbonate, di-t-butylperoxyoxyisophthalate and t-butylperoxyisobutyrate. They can be used alone or in combination of two or more kinds. Among them, organic peroxides are preferred since they can reduce residual polymerizable monomer and impart excellent printing durability.

Among organic peroxides, preferred are peroxy esters, and more preferred are non-aromatic peroxy esters, i.e., peroxy esters having no aromatic ring, since they have excellent initiator efficiency and can reduce residual polymerizable monomer.

The polymerization initiator may be added after the polymerizable monomer composition is dispersed into the aqueous medium and before the polymerizable monomer composition is famed into droplets as described above, or it may be added to the polymerizable monomer composition before the polymerizable monomer composition is dispersed into the aqueous medium.

The added amount of the polymerization initiator used for the polymerization of the polymerizable monomer composition, is preferably from 0.1 part by mass to 20 parts by mass, more preferably from 0.3 part by mass to 15 parts by mass, and still more preferably from 1 part by mass to 10 parts by mass, with respect to 100 parts by mass of the monovinyl monomer.

In the present disclosure, the aqueous medium means a medium containing water as a main component.

In the present disclosure, the dispersion stabilizer is preferably added to the aqueous medium. As the dispersion stabilizer, examples include, but are not limited to, inorganic compounds including sulfates such as barium sulfate and calcium sulfate, carbonates such as barium carbonate, calcium carbonate and magnesium carbonate, phosphates such as calcium phosphate, metal oxides such as aluminum oxide and titanium oxide, and metal hydroxides such as aluminum hydroxide, magnesium hydroxide and iron(II) hydroxide, and organic compounds including water-soluble polymers such as polyvinyl alcohol, methyl cellulose and gelatin, anionic surfactants, nonionic surfactants, and ampholytic surfactants. These dispersion stabilizers can be used alone or in combination of two or more kinds.

Among the above dispersion stabilizers, preferred are colloids of inorganic compounds, and particularly preferred is a colloid of a hardly water-soluble metal hydroxide. By using a colloid of an inorganic compound, particularly a colloid of a hardly water-soluble metal hydroxide, the colored resin particles can have a narrow particle size distribution, and the amount of the dispersion stabilizer remaining after washing can be small, so that the polymerized toner thus obtained can clearly reproduce an image and does not deteriorate environmental stability.

(A-3) Polymerization Process

Formation of the droplets is carried out as described in the above (A-2). The thus-obtained aqueous dispersion medium is heated to polymerize, thereby forming an aqueous dispersion containing the yellow colorant.

The polymerization temperature of the polymerizable monomer composition is preferably 50° C. or more, and more preferably from 60° C. to 95° C. The polymerization reaction time is preferably from 1 hour to 20 hours, and more preferably from 2 hours to 15 hours.

The colored resin particles may be used as they are as a polymerized toner, or they may be mixed with an external additive and used as a polymerized toner. It is preferable that the colored resin particles are so-called core-shell type (or "capsule type") colored resin particles obtained by using the colored resin particles as a core layer and forming a shell layer, which is a layer that is different from the core layer, around the core layer. By covering the core layer composed of a substance having a low softening point with a substance having a higher softening point, the core-shell type colored resin particles can achieve a balance between lowering of fixing temperature and prevention of aggregation during storage.

A method for producing the above-mentioned core-shell type colored resin particles using the colored resin particles, is not particularly limited. The core-shell type colored resin particles can be produced by a conventional method. The in situ polymerization method and the phase separation method are preferable from the viewpoint of production efficiency.

Hereinafter, the method for producing the core-shell type colored resin particles by the in situ polymerization method, will be described.

The core-shell type colored resin particles can be obtained by adding a polymerizable monomer for forming a shell layer (a polymerizable monomer for shell) and a polymerization initiator to an aqueous medium in which the colored resin particles are dispersed, and then polymerizing the monomer.

As the polymerizable monomer for shell, the above-mentioned polymerizable monomers can be used. Among the polymerizable monomers, it is preferable to use monomers that can provide a polymer having a Tg of more than 80° C., such as styrene, acrylonitrile and methyl methacrylate, alone or in combination of two or more kinds.

As the polymerization initiator used for polymerization of the polymerizable monomer for shell, examples include, but are not limited to, water-soluble polymerization initiators including metal persulfates such as potassium persulfate and ammonium persulfate, and azo-type initiators such as 2,2'-azobis(2-methyl-N-(2-hydroxyethyl)propionamide) and 2,2'-azobis(2-methyl-N-(1,1-bis(hydroxymethyl)2-hydroxyethyl)propionamide). These polymerization initiators can be used alone or in combination of two or more kinds. The amount of the polymerization initiator is preferably from 0.1 part by mass to 30 parts by mass, and more preferably from 1 part by mass to 20 parts by mass, with respect to 100 parts by mass of the polymerizable monomer for shell.

The polymerization temperature of the shell layer is preferably 50° C. or more, and more preferably from 60° C. to 95° C. The polymerization reaction time is preferably from 1 hour to 20 hours, and more preferably from 2 hours to 15 hours.

(A-4) Washing, Filtering, Dehydrating and Drying Processes

After the polymerization is completed, the aqueous dispersion of the colored resin particles obtained by the polymerization is preferably subjected to operations of filtering, washing for removal of the dispersion stabilizer, dehydrating and drying, several times as needed, according to a conventional method.

The washing is preferably carried out by the following method. When the inorganic compound is used as the dispersion stabilizer, the dispersion stabilizer is dissolved in water by adding acid or alkali to the aqueous dispersion of the colored resin particles, and then removed. When the colloid of the hardly water-soluble inorganic hydroxide is used as the dispersion stabilizer, the pH of the aqueous dispersion of the colored resin particles is controlled to 6.5 or less by adding acid. As the acid, examples include, but are not limited to, inorganic acids such as sulfuric acid, hydrochloric acid and nitric acid, and organic acids such as formic acid and acetic acid. Sulfuric acid is particularly preferred for its high removal efficiency and small influences on production facilities.

The dehydrating and filtering method is not particularly limited and can be selected from various known methods. As the method, examples include, but are not limited to, a centrifugal filtration method, a vacuum filtration method and a pressure filtration method. Also, the drying method is not particularly limited and can be selected from various methods.

(B) Pulverization Method

In the case of producing the colored resin particles by employing the pulverization method, the colored resin particles are produced by the following processes.

First, a binder resin, a yellow colorant (preferably a yellow colorant treated with a pigment dispersant), and other additives added as needed, such as a charge control agent and a release agent, are mixed by means of a mixer such as a ball mill, a V-type mixer, FM MIXER (product name), a high-speed dissolver, an internal mixer or Forberg. Next, while heating the thus-obtained mixture, the mixture is kneaded by means of a press kneader, a twin screw kneading machine, a roller or the like. The thus-obtained kneaded product is coarsely pulverized by means of a pulverizer such as a hammer mill, a cutter mill or a roller mill, finely pulverized by means of a pulverizer such as a jet mill or a high-speed rotary pulverizer, and then classified into a desired particle diameter by means of a classifier such as a wind classifier or an airflow classifier, thereby obtaining the colored resin particles produced by the pulverization method.

In the pulverization method, those that are provided above in "(A) Suspension polymerization method" can be used as the binder resin, the yellow colorant, the other additives added as needed (such as the charge control agent and the release agent) and the pigment dispersant used for the treatment of the yellow colorant. Similarly to the colored resin particles obtained by the above "(A) Suspension polymerization method", the colored resin particles obtained by the pulverization method can be core-shell type colored resin particles by a method such as the in situ polymerization method.

As the binder resin, resins that have been widely used for toners can be also used. As the binder resin used in the pulverization method, examples include, but are not limited to, polystyrene, styrene-butyl acrylate copolymers, polyester resins and epoxy resins.

2. Colored Resin Particles

The colored resin particles containing the yellow colorant are obtained by the production method such as the above-mentioned "(A) Suspension polymerization method" or "(B) Pulverization method".

Hereinafter, the colored resin particles constituting the toner will be described. The colored resin particles described below encompass both core-shell type colored resin particles and colored resin particles of other types.

The volume average particle diameter (Dv) of the colored resin particles is preferably from 3 μm to 15 μm, and more preferably from 4 μm to 12 μm. When the volume average particle diameter (Dv) is less than 3 μm, the flowability of the polymerized toner may decrease, and a deterioration in transferability and a decrease in image density may occur. When the volume average particle diameter (Dv) is more than 15 μm, image resolution may decrease.

For the colored resin particles, the ratio (Dv/Dn) of the volume average particle diameter (Dv) and the number average particle diameter (Dn) is preferably from 1.0 to 1.3, and more preferably from 1.0 to 1.2. When the ratio Dv/Dn is more than 1.3, there may be a decrease in transferability, image density and resolution. The volume average particle diameter and number average particle diameter of the colored resin particles can be measured by means of a particle size analyzer (product name: MULTISIZER, manufactured by: Beckman Coulter, Inc.), for example.

The average circularity of the colored resin particles of the present disclosure is preferably from 0.96 to 1.00, more preferably from 0.97 to 1.00, and still more preferably from 0.98 to 1.00, from the viewpoint of image reproducibility.

When the average circularity of the colored resin particles is less than 0.96, thin line reproducibility in printing may deteriorate.

As the toner of the present disclosure, the colored resin particles containing the yellow colorant can be used as they are. From the viewpoint of controlling the chargeability, flowability and storage stability of the toner, the colored resin particles may be used as a one-component toner by mixing the colored resin particles with the external additives to add the external additives on the surface of the colored resin particles.

The one-component toner may be mixed with carrier particles to obtain a two-component developer.

A mixer is used to add the external additives on the colored resin particles. The mixer is not particularly limited, as long as it is a mixing device that can add the external additives on the surface of the colored resin particles. For example, the external addition treatment can be carried out by means of a mixer that is capable of mixing, such as FM MIXER (product name, manufactured by: Nippon Coke & Engineering Co., Ltd.), SUPER MIXER (product name, manufactured by: Kawata Manufacturing Co., Ltd.), Q MIXER (product name, manufactured by: Nippon Coke & Engineering Co., Ltd.), MECHANOFUSION SYSTEM (product name, manufactured by: Hosokawa Micron Corporation) and MECHANOMILL (product name, manufactured by: Okada Seiko Co., Ltd.)

As the external additives, examples include, but are not limited to, inorganic fine particles composed of silica, titanium oxide, aluminum oxide, zinc oxide, tin oxide, calcium carbonate, calcium phosphate and/or cerium oxide, and organic fine particles composed of polymethyl methacrylate resin, silicone resin and/or melamine resin. Among them, inorganic fine particles are preferred. Among the inorganic fine particles, silica and/or titanium oxide is preferred, and fine particles composed of silica are particularly preferred.

These external additives can be used alone. However, it is preferable to use them in combination of two or more kinds.

In the present disclosure, it is desirable that the external additives are used in an amount of generally from 0.05 part by mass to 6 parts by mass, and preferably from 0.2 part by mass to 5 parts by mass, with respect to 100 parts by mass of the colored resin particles. When the added amount of the external additives is less than 0.05 part by mass, the toner may be left untransferred. When the added amount of the external additives is more than 6 parts by mass, fog may occur.

4. Toner of the Present Disclosure

The toner of the present disclosure obtained through the above steps uses the combination of the compounds A and B as the yellow colorant: therefore, the toner of the present disclosure is a yellow toner that is, even in small amounts, better in chroma than ever before.

EXAMPLES

Hereinafter, the present disclosure will be described further in detail, with reference to examples and comparative examples. However, the scope of the present disclosure may not be limited to the following examples. Herein, "part(s)" and "%" are based on mass if not particularly mentioned.

Test methods used in the examples and the comparative examples are as follows.

First Embodiment of the Present Disclosure 1-1. Production of Colored Resin Particles <Colored Resin Particles 1-(1)>

(1) Preparation of Polymerizable Monomer Composition for Core

The following raw materials were subjected to wet grinding by means of a media-type disperser: 75 parts of styrene, 25 parts of n-butyl acrylate, 0.1 part of a polymethacrylic acid ester macromonomer (product name: AA6, manufactured by: TOAGOSEI Co., Ltd., Tg: 94° C.), 0.7 part of divinylbenzene, 1.0 part of tetraethylthiuram disulfide, 0.2 part of an aluminum coupling agent (product name: PLENACT AL-M, manufactured by: Ajinomoto Fine-Techno. Co., Inc.) and, as yellow pigment, 6.0 parts of C.I. Pigment Yellow 214 (represented by the following formula (1A), product name: PV FAST YELLOW H9G VP2430, manufactured by: Clariant Corp., CAS No. 254430-12-5, hue angle: 97°) and 3.0 parts of C.I. Pigment Yellow 93 (represented by the above-mentioned formula (2), product name: CROMOPHTAL YELLOW 3G, manufactured by: BASF, CAS No. 5580-57-4, hue angle: 95°). To a mixture obtained by the wet grinding, 0.75 part of a charge control resin (product name: ACRYBASE FCA-161P, manufactured by: Fujikura Kasei Co., Ltd.) and 10 parts of a synthetic ester wax (pentaerythritol tetrastearate, melting point: 76° C.) were added, mixed and dissolved to obtain a polymerizable monomer composition.

Formula (1A)

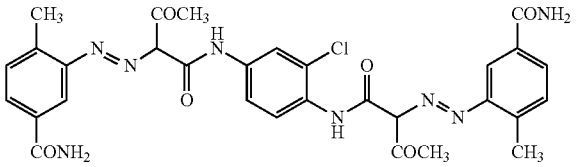

(2) Preparation of Aqueous Dispersion Medium

An aqueous solution of 7.3 parts of sodium hydroxide dissolved in 50 parts of ion-exchanged water, was gradually added to an aqueous solution of 10.4 parts of magnesium chloride dissolved in 280 parts of ion-exchanged water, while stirring, thereby preparing a magnesium hydroxide colloid dispersion.

(3) Preparation of Polymerizable Monomer for Shell

Meanwhile, 2 parts of methyl methacrylate and 130 parts of water were subjected to a fine dispersion treatment by means of an ultrasonic emulsifying machine, thereby preparing an aqueous dispersion of a polymerizable monomer for shell.

(4) Droplets Forming Process

The polymerizable monomer composition was put in the magnesium hydroxide colloid dispersion (the magnesium hydroxide colloid amount: 5.3 parts) and stirred. Then, as a polymerization initiator, 6 parts of t-butylperoxy-2-ethylhexanoate was added thereto. The dispersion containing the polymerization initiator was subjected to dispersion at 15,000 rpm using an in-line type emulsifying and dispersing machine (product name: MILDER, manufactured by: Pacific Machinery & Engineering Co., Ltd.), thereby forming the polymerizable monomer composition into droplets.

(5) Suspension Polymerization Process

The dispersion containing the droplets of the polymerizable monomer composition was put in a reactor. The temperature thereof was increased to 90° C. to start a polymerization reaction. After the polymerization conversion rate reached almost 100%, a solution obtained by dissolving 0.1 part of 2,2'-azobis[2-methyl-N-(2-hydroxyethyl)-propionamide] (a water-soluble polymerization initiator, product name: VA-086, manufactured by: Wako Pure Chemical Industries, Ltd.) in the aqueous dispersion for the polymerizable monomer for shell, was added in the reactor. Next, the temperature of the reactor was kept at 95° C. for 4 hours to continue the polymerization further. Then, the reactor was cooled by water to stop the reaction, thereby obtaining an aqueous dispersion of core-shell type colored resin particles.

(6) Post-Treatment Process

The aqueous dispersion of the colored resin particles was subjected to acid washing (25° C., 10 minutes) by, while stirring the aqueous dispersion, adding sulfuric acid thereto until the pH of the aqueous dispersion reached 4.5 or less. Then, the colored resin particles were separated from the aqueous dispersion by filtration and washed with water. The washing water was filtered. A filtrate thus obtained had an electrical conductivity of 20 μS/cm. The colored resin particles subjected to the washing and filtering processes were dehydrated and dried to obtain dried colored resin particles 1-(1).

<Colored Resin Particles 1-(2) to 1-(8)>

Colored resin particles 1-(2) to 1-(8) were obtained in the same manner as the production method of the colored resin particles 1-(1), except that in the "Preparation of polymerizable monomer composition for core", the type and added amount of the colorant were changed as shown in Table 1-1.

In Table 1-1, "SY114" used in the colored resin particles 1-(6) means C.I. Solvent Yellow 114 represented by the following formula (X) (product name: SOLVAPERM YELLOW 2G, manufactured by Clariant Corp., CAS No. 7576-65-0).

Formula (X)

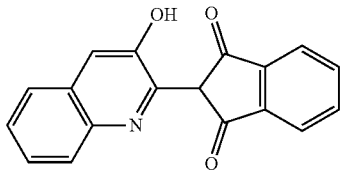

1-2. Evaluation of Properties of Colored Resin Particles

Measurement of volume average particle diameter (Dv) was carried out on the colored resin particles 1-(1) to 1-(8).

About 0.1 g of a measurement sample (colored resin particles) was weighed out and put in a beaker. As a dispersant, 0.1 mL of an alkylbenzene sulfonic acid aqueous solution (product name: DRIWEL, manufactured by: Fujifilm Corporation) was added thereto. In addition, 10 mL to 30 mL of ISOTON II was added to the beaker. The mixture was dispersed for three minutes with a 20 W ultrasonic disperser. Then, the volume average particle diameter (Dv) of the colored resin particles was measured with a particle diameter measuring device (product name: MULTISIZER, manufactured by: Beckman Coulter, Inc.) in the following conditions:

Aperture diameter: 100 μm

Medium: ISOTON II

Number of measured particles: 100,000

1-3. Production of Yellow Toners

The colored resin particles 1-(1) to 1-(8) were subjected to an external addition treatment to produce yellow toners of Examples 1-1 to 1-5 and Comparative Examples 1-1 to 1-3.

Example 1-1

First, 0.6 part of hydrophobized silica fine particles having an average particle diameter of 7 nm and 1 part of hydrophobized silica fine particles having an average particle diameter of 35 nm, were added to 100 parts of the colored resin particles 1-(1). They were mixed by means of a high-speed mixer (product name: FM MIXER, manufactured by: Nippon Coke & Engineering Co., Ltd.) to prepare the yellow toner of Example 1-1.

Examples 1-2 to 1-5 and Comparative Examples 1-1 to 1-3

The yellow toners of Examples 1-2 to 1-5 and Comparative Examples 1-1 to 1-3 were obtained in the same manner as Example 1-1, except that the colored resin particles 1-(1) were changed to, as shown in the following Table 1-1, any of the colored resin particles 1-(2) to 1-(8).

1-4. Evaluation of Toners for Developing Electrostatic Images

The image density, luminance (L*), color coordinate (a*, b*) and chroma (C*) of the yellow toners of Examples 1-1 to 1-5 and Comparative Examples 1-1 to 1-3, were measured as follows.

A commercially-available, non-magnetic one-component development color printer (printing rate: 20 sheets/min) was used. The toner cartridge of the development device was filled with a sample yellow toner, and printing sheets were loaded in the printer. Then, the printer was left to stand under an (N/N) environment at a temperature of 23° C. and a relative humidity of 50% for one day. Then, while the amount of the toner supplied onto the developing roller in solid pattern printing was fixed at 0.3 mg/cm$^2$, sheets were continuously printed at an image density of 5% from the beginning of the printing. Solid pattern printing (image density: 100%) was carried out on the tenth sheet, and using a spectrophotometer (product name: SPECTROEYE, manufactured by: GretagMacbeth), the image density, luminance (L*), color coordinate (a*, b*) and chroma (C*) of the tenth sheet were measured.

Table 1-1 shows the measurement and evaluation results of the yellow toners of Examples 1-1 to 1-5 and Comparative Examples 1-1 to 1-3, along with the toner composition.

In the following Table 1-1, "PY214" means C.I. Pigment Yellow 214; "PY93" means C.I. Pigment Yellow 93; and "SY114" means C.I. Solvent Yellow 114.

TABLE 1-1

| | | Example 1-1 | Example 1-2 | Example 1-3 | Example 1-4 | Example 1-5 | Comparative Example 1-1 | Comparative Example 1-2 | Comparative Example 1-3 |
|---|---|---|---|---|---|---|---|---|---|
| Colored resin particles | | Particles 1-(1) | Particles 1-(2) | Particles 1-(3) | Particles 1-(4) | Particles 1-(5) | Particles 1-(6) | Particles 1-(7) | Particles 1-(8) |
| Colorant | Compound A | PY214 | PY214 | PY214 | PY214 | PY214 | PY214 | PY214 | — |
| | Added amount (parts) | 6.0 | 8.0 | 10.0 | 6.0 | 10.0 | 8.0 | 12.0 | — |
| | Compound B | PY93 | PY93 | PY93 | PY93 | PY93 | — | — | PY93 |
| | Added amount (parts) | 3.0 | 4.0 | 5.0 | 6.0 | 2.0 | — | — | 12.0 |
| | Compound A + Compound B (parts) | 9.0 | 12.0 | 15.0 | 12.0 | 12.0 | 8.0 | 12.0 | 12.0 |
| | Compounds A/B ratio | 2.0 | 2.0 | 2.0 | 1.0 | 5.0 | — | — | — |
| | Other yellow colorant | — | — | — | — | — | SY114 | — | — |
| | Added amount (parts) | — | — | — | — | — | 4.0 | — | — |
| Volume average particle diameter Dv (μm) | | 6.7 | 6.7 | 6.6 | 6.5 | 6.5 | 6.3 | 6.6 | 6.6 |
| Printing evaluation | Reflection density | 1.08 | 1.10 | 1.11 | 1.15 | 1.13 | 1.16 | 1.10 | 1.10 |
| | Luminance L* | 93.3 | 93.5 | 92.0 | 93.5 | 92.8 | 94.3 | 93.6 | 93.1 |
| | a* | −9.1 | −9.7 | −9.0 | −8.8 | −8.7 | −8.5 | −8.2 | −8.7 |
| | b* | 82.8 | 85.0 | 82.5 | 83.5 | 82.5 | 81.1 | 80.3 | 79.8 |
| | Chroma C* | 83.3 | 85.6 | 83.0 | 84.0 | 83.0 | 81.5 | 80.7 | 80.3 |

1-5. Evaluation of Toners

The yellow toner of Comparative Example 1-1 is a toner using the compound A (C.I. Pigment Yellow 214) in combination with C.I. Solvent Yellow 114. For Comparative Example 1-1, the chromaticity b* is as low as 81.1, and the chroma C* is as low as 81.5. Therefore, it was revealed that when C.I. Solvent Yellow 114 is used in place of the compound B, the yellow toner is poor in yellow coloring properties and dull in color.

The yellow toner of Comparative Example 1-2 is a toner in which, with respect to 100 parts by mass of the binder resin, 12.0 parts by mass of the compound A is only used as the yellow colorant. For Comparative Example 1-2, the chromaticity b* is as low as 80.3, and the chroma C* is as low as 80.7. Therefore, it was revealed that when the compound A is used solely as the yellow colorant, the yellow toner is poor in yellow coloring properties and dull in color.

The yellow toner of Comparative Example 1-3 is a toner in which, with respect to 100 parts by mass of the binder resin, 12.0 parts by mass of the compound B is only used as the yellow colorant. For Comparative Example 1-3, the chromaticity b* is as low as 79.8, and the chroma C* is as low as 80.3. These values are the smallest among the evaluated toners. Therefore, it was revealed that when the compound B is used solely as the yellow colorant, the yellow toner is especially poor in yellow coloring properties and especially dull in color.

Meanwhile, the yellow toners of Examples 1-1 to 1-5 are toners in which, with respect to 100 parts by mass of the binder resin, from 6.0 parts by mass to 10.0 parts by mass of the compound A and from 2.0 parts by mass to 6.0 parts by mass of the compound B are contained as the yellow colorant. For Examples 1-1 to 1-5, the chromaticity b* is as high as 82.5 or more, and the chroma C* is as high as 83.0 or more. Therefore, it was revealed that the yellow toners of Examples 1-1 to 1-5 in which, with respect to 100 parts by mass of the binder resin, from 1 part by mass to 15 parts by mass of the compound A and from 0.1 part by mass to 8.0 parts by mass of the compound B are contained as the yellow colorant, are toners that are high in chroma and excellent in yellow coloring properties.

Especially for the yellow toners of Examples 1-1, 1-2 and 1-4, the chromaticity b* is as high as 82.8 or more, and the chroma C* is as high as 83.3 or more. This is thought to be because, in these yellow toners, the total content of the yellow colorant is from 9.0 parts by mass to 12.0 parts by mass with respect to 100 parts by mass of the binder resin, and the mass ratio of the content of the yellow colorant (compound A/compound B) is from 1.0 to 2.0. As just described, since the yellow toners contain the yellow colorant moderately and contain the compounds A and B with balance as the yellow colorant, the dispersibility of especially the compound A can be increased, and as a result, the toners thus obtained are toners that are higher in chroma and excellent in yellow coloring properties.

Second Embodiment of the Present Disclosure

2-1. Production of Colored Resin Particles

<Colored Resin Particles 2-(1)>

(1) Preparation of Polymerizable Monomer Composition for Core

The following raw materials were subjected to wet grinding by means of a media-type disperser: 75 parts of styrene, 25 parts of n-butyl acrylate, 0.1 part of a polymethacrylic acid ester macromonomer (product name: AA6, manufactured by: TOAGOSEI Co., Ltd., Tg: 94° C.), 0.7 part of divinylbenzene, 1.0 part of tetraethylthiuram disulfide, 0.2 part of an aluminum coupling agent (product name: PLENACT AL-M, manufactured by: Ajinomoto Fine-Techno. Co., Inc.) and, as yellow pigment, 6.0 parts of C.I. Pigment Yellow 214 (represented by the following formula (1A), product name: PV FAST YELLOW H9G VP2430, manufactured by: Clariant Corp., CAS No. 254430-12-5, hue angle: 97°) and 3.0 parts of C.I. Pigment Yellow 155 (represented by the above-mentioned formula (3), product name: TONER YELLOW 3GP, manufactured by: Clariant Corp., CAS No. 68516-73-4, hue angle: 95°). To a mixture obtained by the wet grinding, 0.75 part of a charge control resin (product name: ACRYBASE FCA-161P, manufactured by: Fujikura Kasei Co., Ltd.) and 10 parts of a synthetic ester wax (pentaerythritol tetrastearate, melting point: 76° C.) were added, mixed and dissolved to obtain a polymerizable monomer composition.

Formula (1A)

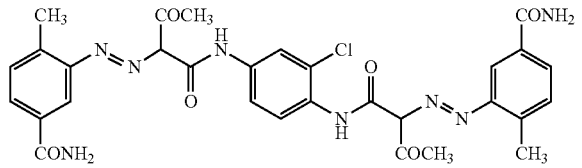

(2) Preparation of Aqueous Dispersion Medium

An aqueous solution of 7.3 parts of sodium hydroxide dissolved in 50 parts of ion-exchanged water, was gradually added to an aqueous solution of 10.4 parts of magnesium chloride dissolved in 280 parts of ion-exchanged water, while stirring, thereby preparing a magnesium hydroxide colloid dispersion.

(3) Preparation of Polymerizable Monomer for Shell

Meanwhile, 2 parts of methyl methacrylate and 130 parts of water were subjected to a fine dispersion treatment by means of an ultrasonic emulsifying machine, thereby preparing an aqueous dispersion of a polymerizable monomer for shell.

(4) Droplets Forming Process

The polymerizable monomer composition was put in the magnesium hydroxide colloid dispersion (the magnesium hydroxide colloid amount: 5.3 parts) and stirred. Then, as a polymerization initiator, 6 parts of t-butylperoxy-2-ethylhexanoate was added thereto. The dispersion containing the polymerization initiator was subjected to dispersion at 15,000 rpm using an in-line type emulsifying and dispersing machine (product name: MILDER, manufactured by: Pacific Machinery & Engineering Co., Ltd.), thereby forming the polymerizable monomer composition into droplets.

(5) Suspension Polymerization Process

The dispersion containing the droplets of the polymerizable monomer composition was put in a reactor. The temperature thereof was increased to 90° C. to start a polymerization reaction. After the polymerization conversion rate reached almost 100%, a solution obtained by dissolving 0.1 part of 2,2'-azobis[2-methyl-N-(2-hydroxyethyl)-propionamide] (a water-soluble polymerization initiator, product name: VA-086, manufactured by: Wako Pure Chemical Industries, Ltd.) in the aqueous dispersion for the polymerizable monomer for shell, was added in the reactor. Next, the temperature of the reactor was kept at 95° C. for 4 hours to continue the polymerization further. Then, the reactor was cooled by water to stop the reaction, thereby obtaining an aqueous dispersion of core-shell type colored resin particles.

(6) Post-Treatment Process

The aqueous dispersion of the colored resin particles was subjected to acid washing (25° C., 10 minutes) by, while stirring the aqueous dispersion, adding sulfuric acid thereto until the pH of the aqueous dispersion reached 4.5 or less. Then, the colored resin particles were separated from the aqueous dispersion by filtration and washed with water. The washing water was filtered. A filtrate thus obtained had an electrical conductivity of 20 μS/cm. The colored resin particles subjected to the washing and filtering processes were dehydrated and dried to obtain dried colored resin particles 2-(1).

<Colored Resin Particles 2-(2) to 2-(8)>

Colored resin particles 2-(2) to 2-(8) were obtained in the same manner as the production method of the colored resin particles 2-(1), except that in the "Preparation of polymerizable monomer composition for core", the type and added amount of the colorant were changed as shown in Table 2-1.

In Table 2-1, "SY114" used in the colored resin particles 2-(6) means C.I. Solvent Yellow 114 represented by the following formula (X) (product name: SOLVAPERM YELLOW 2G, manufactured by: Clariant Corp., CAS No. 7576-65-0).

Formula (X)

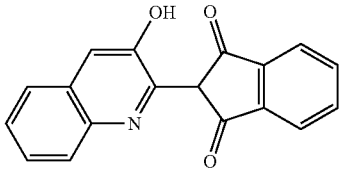

2-2. Evaluation of Properties of Colored Resin Particles

Measurement of volume average particle diameter (Dv) was carried out on the colored resin particles 2-(1) to 2-(8).

About 0.1 g of a measurement sample (colored resin particles) was weighed out and put in a beaker. As a dispersant, 0.1 mL of an alkylbenzene sulfonic acid aqueous solution (product name: DRIWEL, manufactured by: Fujifilm Corporation) was added thereto. In addition, 10 mL to 30 mL of ISOTON II was added to the beaker. The mixture was dispersed for three minutes with a 20 W ultrasonic disperser. Then, the volume average particle diameter (Dv) of the colored resin particles was measured with a particle diameter measuring device (product name: MULTISIZER, manufactured by: Beckman Coulter, Inc.) in the following conditions:

Aperture diameter: 100 μm

Medium: ISOTON II

Number of measured particles: 100,000

2-3. Production of Yellow Toners

The colored resin particles 2-(1) to 2-(8) were subjected to an external addition treatment to produce yellow toners of Examples 2-1 to 2-5 and Comparative Examples 2-1 to 2-3.

Example 2-1

First, 0.6 part of hydrophobized silica fine particles having an average particle diameter of 7 nm and 1 part of hydrophobized silica fine particles having an average particle diameter of 35 nm, were added to 100 parts of the colored resin particles 2-(1). They were mixed by means of a high-speed mixer (product name: FM MIXER, manufactured by: Nippon Coke & Engineering Co., Ltd.) to prepare the yellow toner of Example 2-1.

Examples 2-2 to 2-5 and Comparative Examples 2-1 to 2-3

The yellow toners of Examples 2-2 to 2-5 and Comparative Examples 2-1 to 2-3 were obtained in the same manner as Example 2-1, except that the colored resin particles 2-(1) were changed to, as shown in the following Table 2-1, any of the colored resin particles 2-(2) to 2-(8).

2-4. Evaluation of Toners for Developing Electrostatic Images

The image density, luminance (L*), color coordinate (a*, b*) and chroma (C*) of the yellow toners of Examples 2-1 to 2-5 and Comparative Examples 2-1 to 2-3, were measured as follows.

A commercially-available, non-magnetic one-component development color printer (printing rate: 20 sheets/min) was used. The toner cartridge of the development device was filled with a sample yellow toner, and printing sheets were loaded in the printer. Then, the printer was left to stand under an (N/N) environment at a temperature of 23° C. and a relative humidity of 50% for one day. Then, while the amount of the toner supplied onto the developing roller in solid pattern printing was fixed at 0.3 mg/cm$^2$, sheets were continuously printed at an image density of 5% from the beginning of the printing. Solid pattern printing (image density: 100%) was carried out on the tenth sheet, and using the spectrophotometer (product name: SPECTROEYE, manufactured by: GretagMacbeth), the image density, luminance (L*), color coordinate (a*, b*) and chroma (C*) of the tenth sheet were measured.

Table 2-1 shows the measurement and evaluation results of the yellow toners of Examples 2-1 to 2-5 and Comparative Examples 2-1 to 2-3, along with the toner composition.

In the following Table 2-1, "PY214" means C.I. Pigment Yellow 214; "PY155" means C.I. Pigment Yellow 155; and "SY114" means C.I. Solvent Yellow 114.

TABLE 2-1

| | | Example 2-1 | Example 2-2 | Example 2-3 | Example 2-4 | Example 2-5 | Comparative Example 2-1 | Comparative Example 2-2 | Comparative Example 2-3 |
|---|---|---|---|---|---|---|---|---|---|
| Colored resin particles | | Particles 2-(1) | Particles 2-(2) | Particles 2-(3) | Particles 2-(4) | Particles 2-(5) | Particles 2-(6) | Particles 2-(7) | Particles 2-(8) |
| Colorant | Compound A | PY214 | PY214 | PY214 | PY214 | PY214 | PY214 | PY214 | — |
| | Added amount (parts) | 6.0 | 8.0 | 10.0 | 6.0 | 10.0 | 8.0 | 12.0 | — |
| | Compound B | PY155 | PY155 | PY155 | PY155 | PY155 | — | — | PY155 |
| | Added amount (parts) | 3.0 | 4.0 | 5.0 | 6.0 | 2.0 | — | — | 12.0 |
| | Compound A + Compound B (parts) | 9.0 | 12.0 | 15.0 | 12.0 | 12.0 | 8.0 | 12.0 | 12.0 |
| | Compounds A/B ratio | 2.0 | 2.0 | 2.0 | 1.0 | 5.0 | — | — | — |
| | Other yellow colorant | — | — | — | — | — | SY114 | — | — |
| | Added amount (parts) | — | — | — | — | — | 4.0 | — | — |
| Volume average particle diameter Dv (μm) | | 6.5 | 6.6 | 6.6 | 6.4 | 6.5 | 6.4 | 6.6 | 6.5 |
| Printing evaluation | Reflection density | 1.06 | 1.10 | 1.12 | 1.13 | 1.14 | 1.16 | 1.10 | 1.11 |
| | Luminance L* | 93.4 | 93.5 | 92.6 | 92.9 | 92.8 | 94.3 | 93.6 | 92.6 |
| | a* | −9.0 | −9.6 | −9.2 | −8.7 | −8.5 | −8.5 | −8.2 | −8.5 |
| | b* | 82.6 | 84.8 | 82.4 | 83.0 | 82.5 | 81.1 | 80.3 | 79.0 |
| | Chroma C* | 83.1 | 85.3 | 82.9 | 83.5 | 82.9 | 81.5 | 80.7 | 79.5 |

2-5. Evaluation of Toners

The yellow toner of Comparative Example 2-1 is a toner using the compound A (C.I. Pigment Yellow 214) in combination with C.I. Solvent Yellow 114. For Comparative Example 2-1, the chromaticity b* is as low as 81.1, and the chroma C* is as low as 81.5. Therefore, it was revealed that when C.I. Solvent Yellow 114 is used in place of the compound B, the yellow toner is poor in yellow coloring properties and dull in color.

The yellow toner of Comparative Example 2-2 is a toner in which, with respect to 100 parts by mass of the binder resin, 12.0 parts by mass of the compound A is only used as the yellow colorant. For Comparative Example 2-2, the chromaticity b* is as low as 80.3, and the chroma C* is as low as 80.7. Therefore, it was revealed that when the compound A is used solely as the yellow colorant, the yellow toner is poor in yellow coloring properties and dull in color.

The yellow toner of Comparative Example 2-3 is a toner in which, with respect to 100 parts by mass of the binder resin, 12.0 parts by mass of the compound B is only used as the yellow colorant. For Comparative Example 2-3, the chromaticity b* is as low as 79.0, and the chroma C* is as low as 79.5. These values are the smallest among the evaluated toners. Therefore, it was revealed that when the compound B is used solely as the yellow colorant, the yellow toner is especially poor in yellow coloring properties and especially dull in color.

Meanwhile, the yellow toners of Examples 2-1 to 2-5 are toners in which, with respect to 100 parts by mass of the binder resin, from 6.0 parts by mass to 10.0 parts by mass of the compound A and from 2.0 parts by mass to 6.0 parts by mass of the compound B are contained as the yellow colorant. For Examples 2-1 to 2-5, the chromaticity b* is as high as 82.4 or more, and the chroma C* is as high as 82.9 or more. Therefore, it was revealed that the yellow toners of Examples 2-1 to 2-5 in which, with respect to 100 parts by mass of the binder resin, from 1 part by mass to 15 parts by mass of the compound A and from 0.1 part by mass to 8.0 parts by mass of the compound B are contained as the yellow colorant, are toners that are high in chroma and excellent in yellow coloring properties.

Especially for the yellow toners of Examples 2-1, 2-2 and 2-4, the chromaticity b* is as high as 82.6 or more, and the chroma C* is high as 83.1 or more. This is thought to be because, in these yellow toners, the total content of the yellow colorant is from 9.0 parts by mass to 12.0 parts by mass with respect to 100 parts by mass of the binder resin, and the mass ratio of the content of the yellow colorant (compound A/compound B) is from 1.0 to 2.0. As just described, since the yellow toners contain the yellow colorant moderately and contain the compounds A and B with balance as the yellow colorant, the dispersibility of especially the compound A can be increased, and as a result, the toners thus obtained are toners that are higher in chroma and excellent in yellow coloring properties.

The invention claimed is:

1. A yellow toner comprising a binder resin and a yellow colorant, wherein, as the yellow colorant, a compound A represented by the following general formula (1) and a compound B represented by the following formula (2) are contained, and wherein, with respect to 100 parts by mass of the binder resin, a content of the compound A is from 1 part by mass to 15 parts by mass, and a content of the compound B is from 0.1 part by mass to 8.0 parts by mass:

General Formula (1)

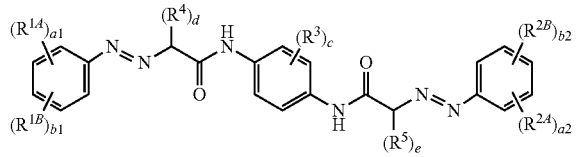

where $R^{1A}$, $R^{1B}$, $R^{2A}$ and $R^{2B}$ are each independently a halogen atom, an alkyl group, an alkoxy group, an amino group, a nitro group, an acetylamido group (—$NHCOCH_3$), a methyl ester group (—$COOCH_3$) or a primary amide group (—$CONH_2$); $R^3$ is a halogen atom; $R^4$ and $R^5$ are each independently a halogen atom, an alkyl group, a methoxy group, an amino group, a nitro group, an acetylamido group (—$NHCOCH_3$), an acetyl group (—$COCH_3$), a methyl ester group (—$COOCH_3$) or a primary amide group (—$CONH_2$); a1 and b1 are non-negative integers that a sum of the non-negative integers a1 and b1 is 1 or more and 3 or less; a2 and b2 are non-negative integers that a sum of the non-negative integers a2 and b2 is 1 or more and 3 or less; c is an integer of 1 or more and 3 or less; and d and e are each independently 1 or 2, Formula (2)

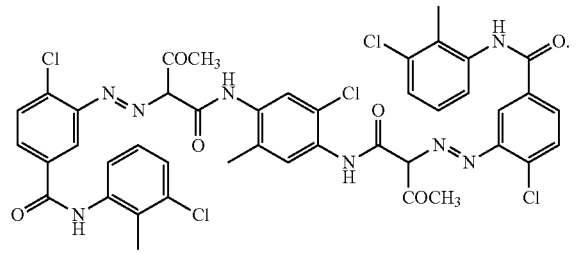

2. The yellow toner according to claim 1, wherein a mass ratio of the content of the compound A to the content of the compound B (compound A/compound B) is from 0.1 to 10.0.

* * * * *